US007520597B2

(12) United States Patent
Ito

(10) Patent No.: US 7,520,597 B2
(45) Date of Patent: Apr. 21, 2009

(54) INKJET PRINTHEAD AND METHOD OF ASSEMBLING THE SAME

(75) Inventor: Atsushi Ito, Nagoya (JP)

(73) Assignee: Brother Kogyo Kabushiki Kaisha (JP)

( * ) Notice: Subject to any disclaimer, the term of this patent is extended or adjusted under 35 U.S.C. 154(b) by 368 days.

(21) Appl. No.: 11/249,346

(22) Filed: Oct. 14, 2005

(65) Prior Publication Data

US 2006/0082618 A1 Apr. 20, 2006

(30) Foreign Application Priority Data

Oct. 14, 2004 (JP) ..... 2004-299693

(51) Int. Cl.
*B41J 2/045* (2006.01)

(52) U.S. Cl. ..... 347/71

(58) Field of Classification Search ..... 347/71, 347/72; 29/890.01

See application file for complete search history.

(56) References Cited

U.S. PATENT DOCUMENTS 6,773,095 B2 8/2004 Isono

2003/0067510 A1* 4/2003 Isono ..... 347/68

FOREIGN PATENT DOCUMENTS

JP 2003112423 4/2003

* cited by examiner

*Primary Examiner*—Matthew Luu
*Assistant Examiner*—Lisa M Solomon
(74) *Attorney, Agent, or Firm*—Banner & Witcoff, Ltd.

(57) ABSTRACT

There is disclosed an inkjet printhead comprising a cavity unit and an actuator. The cavity unit includes a plurality of nozzles each for ejecting a droplet of ink, a plurality of pressure chambers formed on a surface of the cavity unit on a first side thereof to respectively correspond to the nozzles, and a first detection portion formed in a given positional relationship with the pressure chambers. The actuator is disposed on the cavity unit, and includes a plurality of pressure producing portions that correspond to the respective pressure chambers so as to selectively apply a pressure to the ink in each of the pressure chambers. The first detection portion allows light as radiated from a second side of the cavity unit that is opposite to the first side, to pass through the first detection portion to the first side, and is used for positioning of the cavity unit relatively to the actuator so that the pressure chambers and the respectively corresponding pressure producing portions are positioned relatively to each other.

7 Claims, 9 Drawing Sheets

INKJET PRINTHEAD AND METHOD OF ASSEMBLING THE SAME

INCORPORATION BY REFERENCE

The present application is based on Japanese Patent Application No. 2004-299693, filed on Oct. 14, 2004, the content of which is incorporated herein by reference.

BACKGROUND OF THE INVENTION

1. Field of the Invention

The invention relates to an inkjet printhead, and particularly to an inkjet printhead formed by positioning and laminating an actuator to a cavity unit in which a plurality of nozzles are formed, and a method of assembling such an inkjet printhead.

2. Description of Related Art

As a conventional inkjet printhead, there is known a piezoelectric inkjet printhead, as disclosed in FIGS. 3, 8 and 9 of JP-A-2003-112423 applied by the present applicant, for instance, which comprises a cavity unit having a plurality of nozzles and a plurality of pressure chambers respectively corresponding to the nozzles, a planar piezoelectric actuator having a plurality of active portions respectively corresponding to the pressure chambers, and a flexible flat cable for supplying power to the piezoelectric actuator.

The cavity unit is formed by stacking and bonding to one another a nozzle plate with the nozzles formed therethrough, a cavity plate where a plurality of through-holes providing the pressure chambers are formed, and other plates each with a plurality of ink passages, such as those providing a plurality of common ink chambers, formed therethrough. The piezoelectric actuator is formed by alternately stacking and bonding a plurality of piezoelectric sheets on each of which a plurality of individual electrodes are formed, and a plurality of piezoelectric sheets on each of which a common electrode common to a group of pressure chambers is formed. Each portion sandwiched between an individual electrode and a common electrode serves as an active portion.

The piezoelectric actuator is superposed on and bonded to the cavity unit such that the pressure chambers positionally correspond to the respective active portions. Further, a flexible flat cable is superposed on and bonded to the piezoelectric actuator so as to be capable of selectively supplying power to the individual electrodes. When a particular active portion is supplied with power and contacts, the contraction deforms a corresponding one of the pressure chambers so as to eject a droplet of ink from a nozzle in communication with the pressure chamber.

In the inkjet printhead constructed as described above, the ejection of ink droplets from the nozzles is greatly affected by the degree of alignment of the active portions with the pressure chambers, the piezoelectric actuator and the cavity unit should be positioned relatively each other with a high accuracy and precision.

Thus, the present applicant has proposed in the above-mentioned publication, a way of positioning a piezoelectric actuator and a cavity unit relatively to each other accurately and precisely. That is, a reference point of the piezoelectric actuator 12 as has been fired is accurately and precisely obtained with an image processor, based on four detection portions that are respectively formed at four corners of the piezoelectric actuator, and similarly, a reference point of the cavity unit is similarly obtained, based on four detection portions that are respectively formed at four corners of the cavity unit. Then, the piezoelectric actuator and the cavity unit are moved relatively to each other so that these reference points are aligned. In this way, an accurate and precise positioning between the piezoelectric actuator and the cavity unit is realized.

The plates constituting the cavity unit are typically formed of metal, since the ink passages and others are usually formed by etching. Thus, the cavity unit does not allow light to pass therethrough in a direction of stacking of the plates. Hence, the present applicant has proposed to provide detection portions in the form of four small holes, in a topmost one of the plates of the cavity unit, and acquire the position of the holes by processing, by an image processor, an image obtained by irradiating the cavity unit at each of the positions where the holes are formed, from the upper side of the cavity unit that corresponds to an back or inner side of the cavity unit that is remote from a nozzle surface thereof in which the nozzles are arranged.

However, the above-described technique suffers from a problem that the holes serving as detection portions are recognized based on light reflected from the cavity unit, and accordingly the obtained images are low in contrast. In addition, since the plates of the cavity unit have flaws such as streaks made during rolling, where the detection of the holes is performed by directly irradiating with light an inner or back surface of the cavity unit in which the hole is formed, the image processor tends to erroneously recognize the contour of each hole due to the presence of the flaws, leading to low accuracy and low preciseness in detecting the detection portions of the cavity unit.

SUMMARY OF THE INVENTION

The present invention has been developed in view of the above-described situations, and therefore it is an object of the invention to provide an inkjet printhead comprising a piezoelectric actuator and a cavity unit where detection portions formed in the cavity unit are accurately and precisely detectable in order to enhance the accuracy and precision in positioning the actuator and the cavity unit relatively to each other, and a method of assembling such an inkjet printhead.

To attain the above object, the invention provides an inkjet printhead comprising a cavity unit and an actuator. The cavity unit includes a plurality of nozzles each for ejecting a droplet of ink, a plurality of pressure chambers formed on a surface of the cavity unit on a first side thereof to respectively correspond to the nozzles, and a first detection portion formed in a given positional relationship with the pressure chambers. The actuator is disposed on the cavity unit, and includes a plurality of pressure producing portions that correspond to the respective pressure chambers so as to selectively apply a pressure to the ink in each of the pressure chambers. The first detection portion allows light as radiated from a second side of the cavity unit that is opposite to the first side, to pass through the first detection portion to the first side, and is used for positioning of the cavity unit relatively to the actuator so that the pressure chambers and the respectively corresponding pressure producing portions are positioned relatively to each other.

According to this arrangement, the contrast between the light as has transmitted through the detection portion, and a contour of the detection portion or a member defining the detection portion inside thereof is relatively high, enabling to detect the detection portion accurately and precisely, without adversely affected by a flaw or the like in a surface of the cavity unit, if any. Thus, each of the pressure chambers and a corresponding one of the pressure producing portions are positioned relatively to each other with high accuracy and precision, when the actuator is superposed on the cavity unit.

The present invention also provides a method for assembling an inkjet printhead by laminating (a) a cavity unit having a plurality of nozzles each for ejecting a droplet of ink and a plurality of pressure chambers formed on a surface of the cavity unit on a first side thereof to respectively correspond to the nozzles, and (b) an actuator including a plurality of pressure producing portions that correspond to the respective pressure chambers so as to selectively apply a pressure to the ink in each of the pressure chambers. The method comprises: forming in the cavity unit a detection portion that allows transmission therethrough of light as radiated from a second side of the cavity unit that is opposite to the first side, to the first side, in a given positional relationship with the pressure chambers; irradiating the detection portion with light from the second side of the cavity unit to the first side to take an image of the detection portion from the first side; and laminating the actuator to the cavity unit, by positioning the cavity unit and the actuator positioned relatively to each other based on the taken image, such that the pressure chambers and the respectively corresponding pressure producing portions are positioned relatively to each other.

According to this method, the same effects as described above with respect to the inkjet printhead are obtained.

BRIEF DESCRIPTION OF THE DRAWINGS

The above and other objects, features, advantages and technical and industrial significance of the present invention will be better understood by reading the following detailed description of preferred embodiments of the invention, when considered in connection with the accompanying drawings, in which.

DETAILED DESCRIPTION OF PREFERRED EMBODIMENTS

Hereinafter, there will be described one embodiment of the invention, by referring to the accompanying drawings.

Figure 1:
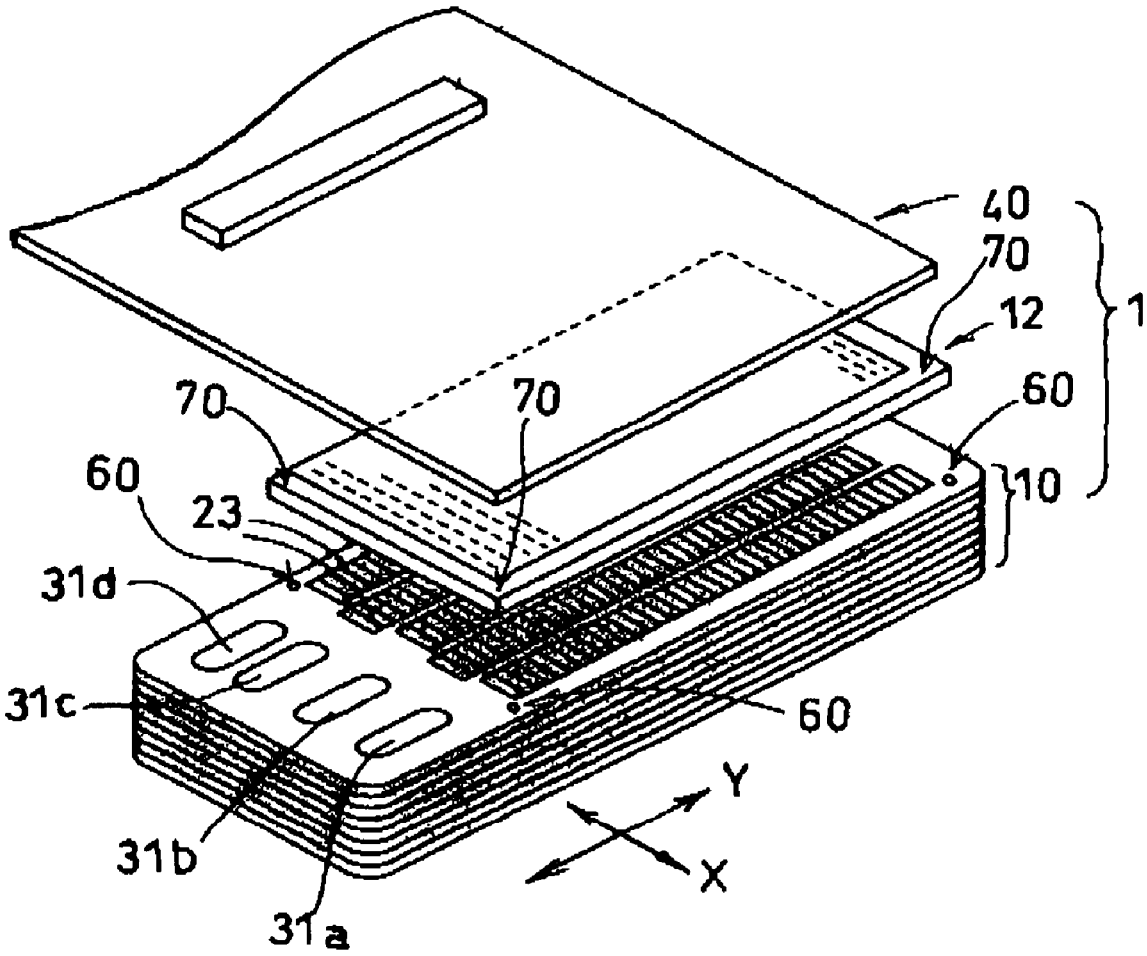
FIG. 1 is an exploded perspective view of an inkjet printhead according to one embodiment of the invention.

Referring first to FIG. 1, reference numeral 1 generally denotes an inkjet printhead 1 according to the embodiment of the invention. Although not shown, the inkjet printhead 1 is disposed in a head unit of an image forming apparatus, for instance, which head unit is mounted on a carriage to be reciprocated in a first direction, which is an X-axis direction parallel to a main scanning direction and perpendicular to a second direction in which a recording medium is fed. The second direction is a Y-axis direction and parallel to an auxiliary scanning direction. Ink cartridges of respective color inks, for instance, four ink cartridges containing inks of cyan, magenta, yellow, and black, respectively, are removably mounted on the head unit. Alternatively, the inks of respective colors may be supplied from ink cartridges fixed in position in a main body of the image forming apparatus via supply tubes (not shown) and damper chambers (not shown) on the carriage.

As shown in FIG. 1, the inkjet printhead 1 includes a cavity unit 10 and a piezoelectric actuator 12. The cavity unit has rows of nozzles 11*a* (shown in FIG. 2) in a front surface thereof, i.e., a lower surface as seen in FIG. 1, which will be referred to as "nozzle surface", such that each of the nozzle rows extends in the Y-axis direction or the second direction. The inkjet printhead 1 includes the cavity unit 10 having the nozzle rows (five rows in the present embodiment) arranged in the X-axis direction at suitable intervals, the piezoelectric actuator 12 of planar type that is superposed on and bonded to an upper surface of the cavity unit 10 with an adhesive or an adhesive sheet, and a flexible flat cable 40 as an example of a wiring board superposed on and bonded to a back surface or an upper surface of the piezoelectric actuator 12, so as to establish electrical connection with an external device.

Figure 2:
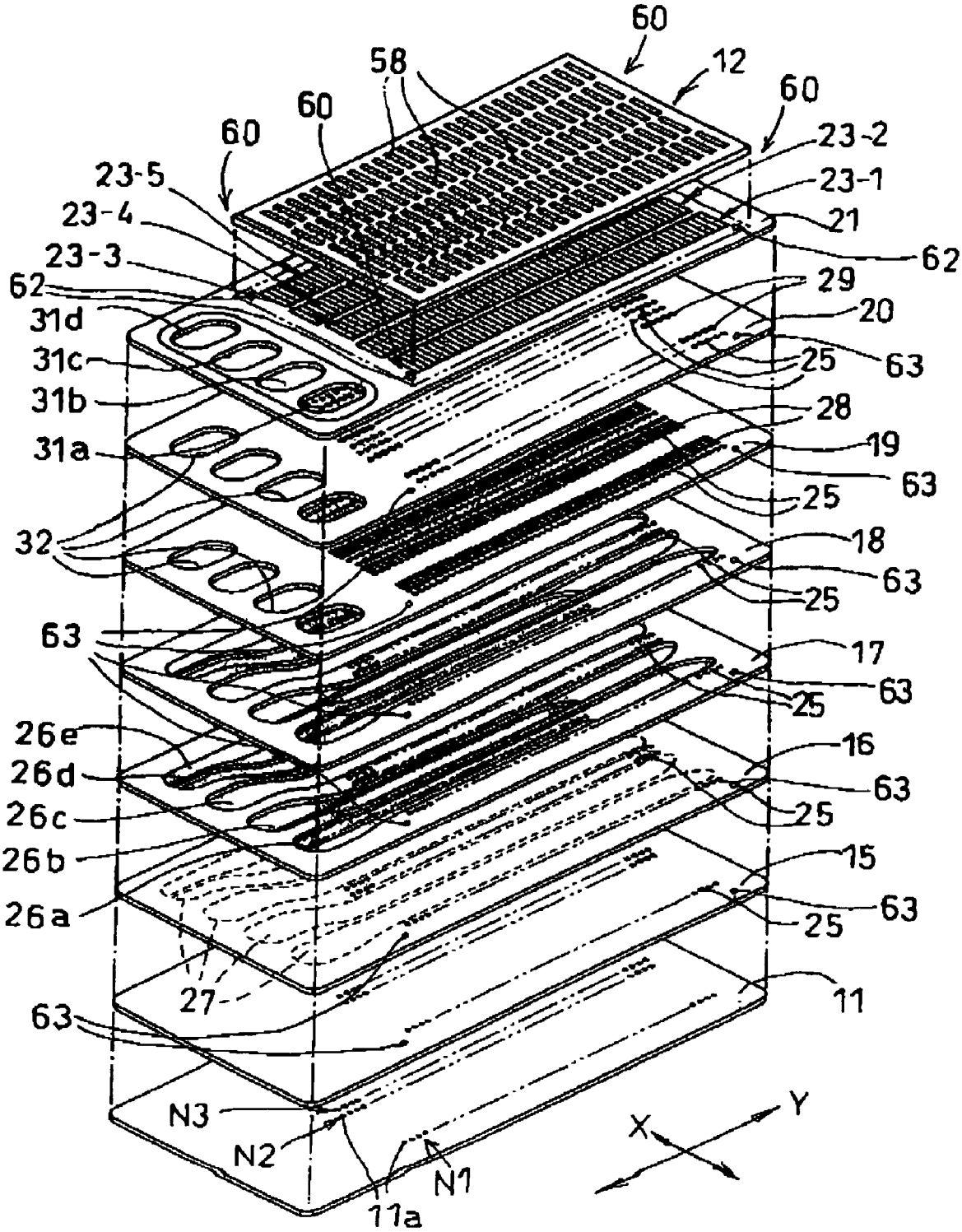
FIG. 2 is an exploded perspective view of a cavity unit constituting the inkjet printhead.

A structure of the cavity unit 10 is shown in FIG. 2. That is, eight flat plates, namely, a nozzle plate 11, a spacer plate 15, a damper plate 16, an upper manifold plate 17, a lower manifold plate 18, a supply plate 19, a base plate 20, and a cavity plate 21 in which a plurality of pressure chambers 23 are formed, are stacked in the order of description from the bottom, and bonded one to another with adhesive. The nozzle plate 11 is made of synthetic resin, and each of the other plates 15-21 is made of a nickel alloy steel sheet containing 42% of nickel and has a thickness of about 50 to 150 μm.

The nozzle plate 11 is made of polyimide and has a light transmission. A large number of the nozzles 11*a* each having a very small diameter (about 25 μm in the present embodiment) are formed in the nozzle plate 11 so as to eject ink droplets therefrom. More specifically, the nozzles 11*a* are arranged in five rows in a staggered fashion, such that each of the nozzle rows extends in the second direction or the auxiliary scanning direction that is parallel to a longitudinal direction of the cavity unit 10 and Y-axis direction as shown in FIG. 2. Thus, the rive nozzle rows N are arranged in the X-axis direction or the main scanning direction at suitable intervals. Hereinafter, and in the drawings, the individual nozzle rows are denoted by reference symbols N1, N2, N3, N4 and N5. It is noted, however, that the nozzle rows N4 and N5 are not shown in the drawings. Each nozzle row N1-N5 has a length of one inch, and consists of 75 nozzles 11*a*. Thus, the nozzles are arranged in a density of 75 dpi (dot per inch) in the direction of each row.

The nozzle rows N1-N5 are arranged from right to left as seen in FIG. 2. The nozzle rows N1-N3 are for cyan ink (C), yellow ink (Y), and magenta ink (M), respectively. The other nozzle rows N4 and N5 are for black ink (BK).

Five ink channels each long in the Y-axis direction are formed through each of the upper and lower manifold plates 17, 18, to respectively correspond to the nozzle rows N1-N5. When the plates 11 and 15-21 are stacked with the manifold plates 17, 18 are sandwiched between the supply plate 19 on the upper side and the damper plate 16 on the lower side, the ink channels constitutes five common ink chambers or manifold chambers 26. The individual common ink chambers will be denoted by reference numerals 26*a*, 26*b*, 26*c*, 26*d*, 26*e*, from right to left as seen in FIG. 2. The common ink chambers 26*a*, 26*b*, 26*c* are for the cyan ink (C), yellow ink (Y), and magenta ink (M), respectively, and the other two, i.e., the common ink chambers 26*d*, 26*e*, are for black ink (BK).

As shown in FIG. 2, four ink supply ports are formed through the cavity plate 21 at an end portion thereof in the Y-axis direction. The ink supply ports are arranged at suitable intervals along the X-axis direction, and denoted by reference numerals 31*a*, 31*b*, 31*c*, 31*d*, respectively, from right to left as seen in FIG. 2. The ink supply ports 31*a*, 31*b*, 31*c* respectively correspond to longitudinal end portions of the common ink chambers 26*a*, 26*b*, 26*c* on the right side of the manifold plates 17, 18, and the fourth ink supply port 31*d* as counted from right commonly corresponds to longitudinal end portions of the two common ink chambers 26*d*, 26*e* that are disposed close to each other. As shown in FIG. 2, at a longitudinal end portion of each of the base plate 20 and supply plate 19, four through-holes are formed to form four ink supply passages 32 when the plates 11 and 15-21 are stacked. The positions of the ink supply passages 32 correspond to those of the ink supply ports 31, so that the ink supply passages 32 communicate the ink supply ports 31 to the longitudinal end portions of the respectively corresponding common ink chambers 26.

Five damper chambers 27 are formed in a lower surface of the damper plate 16 bonded to a lower surface of the lower manifold plate 17. That is, each of the damper chambers 27 is a recess open downward and long in the Y-axis direction, and the positions of the damper chambers 27 correspond to those of the respectively corresponding common ink chambers 26. The recesses are covered by the space plate 15 disposed immediately under the damper plate 16, so as to form completely closed damper chambers.

A backward component of each of pressure waves acting on the pressure chambers 23 due to actuation of the piezoelectric actuator 12, is propagated through the ink, proceeds toward the corresponding common ink chamber 26, and is absorbed by vibration of portions of the damper plate 16 where the thickness is relatively small. Thus, occurrence of a crosstalk is prevented.

Figure 3:
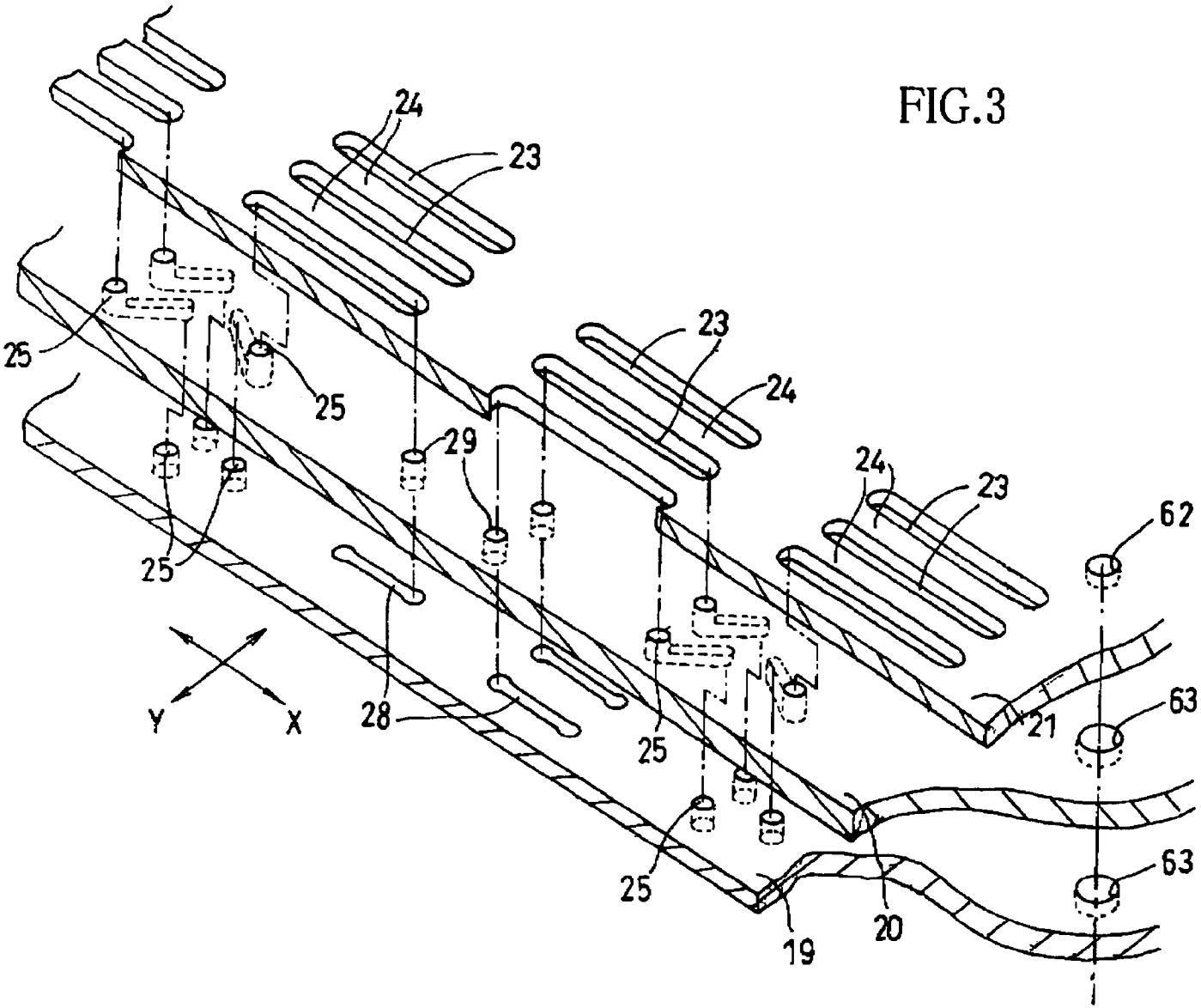
FIG. 3 is an exploded perspective view of a part of the cavity unit in enlargement.

The supply plate 19 has orifices 28 to respectively positionally correspond to the nozzles 11*a* aligned in rows N1-N5. Each orifice 28 has the shape of a groove slightly long in the X-axis direction, in other words, narrow in the Y-axis direction. One of opposite ends (or first end) of each orifice 28 is communicated with a corresponding one of the common ink chambers 26*a*-26*e* formed in the manifold plate 18, while the other end (or second end) of each orifice 28 is communicated with a corresponding one of communication holes 29 formed through the base plate 20 located on the upper side of the supply plate 19, as shown in FIG. 3.

There are formed, through all of the spacer plate 15, the damper plate 16, the two manifold plates 17, 18, the supply plate 19, and the base plate 20, communication passages 25 that are in communication with the nozzles 11*a* aligned in rows N1-N5, at positions aligned with neither the common ink chambers 26 nor the damper chambers 27 in the vertical direction.

Through the base plate 21 are formed pressure chambers 23 arranged in rows, which will be respectively denoted by reference numerals 23-1, 23-2, 23-3, 23-4, 23-5. The rows 23-1 to 23-5 of the pressure chambers 23 correspond to the nozzle rows N1-N5, respectively, and each of the rows 23-1 to 23-5 consists of a number of the pressure chambers 23 corresponding to the number of the nozzles 11*a* aligned in a row. Each of the pressure chambers 23 is long in the X-direction, and one of opposite ends of each pressure chamber 23 in the longitudinal direction thereof or the X-direction is in communication with the second end of a corresponding one of the orifices 28 via the corresponding communication hole 29 formed through the second spacer plate 20, while the other longitudinal end of each pressure chamber 23 is in communication with a corresponding one of the communication passages 25 formed through the base plate 20. The pressure chambers 23 are arranged in rows extending along the Y-axis direction with a partition wall 24 between each adjacent two pressure chambers. The pressure chambers 23 are misaligned with respect to the pressure chambers 23 of the adjacent row(s), by a half of a pitch at which the pressure chambers 23 are arranged in rows in the Y-axis direction, namely, the rows of the pressure chambers 23 are arranged in a staggered configuration.

According to the above-described arrangement, the ink flowed into the common ink chamber 26*a*-26*e* from the ink supply port 31*a*-35*d* is distributed to the corresponding pressure chambers 23 through the orifices 28 and communication holes 29, and then flowed from the pressure chambers 23 to the nozzles 11*a* through the communication passages 25.

There will be now described a structure of the piezoelectric actuator 12. The piezoelectric actuator 12 has active portions each of which is constituted by a part of a laminate formed by stacking piezoelectric sheets where individual electrodes 36 and common electrode 37 are formed alternately between the stacked piezoelectric sheets such that the individual electrodes 36 and the common electrodes 37 are opposed to each other in the vertical direction via the piezoelectric sheets. When a high voltage is applied between an individual electrodes and a common electrode respectively disposed on opposite sides of a piezoelectric sheet, the piezoelectric sheet is polarized at a portion sandwiched between the individual and common electrodes. By applying a voltage between a desired one of the individual electrodes 36 and the common electrode 36, in a direction parallel to the polarizing direction, a deflection in the stacking direction occurs at the active portion corresponding to the individual electrode 36 to which the voltage is applied, due to the piezoelectric longitudinal effect. The active portions are formed in rows of the same number as the rows of the pressure chambers 23, with each row consisting of active portions of the same number as each row of the pressure chambers 23, and at positions respectively corresponding to the pressure chambers 23.

More specifically, the active portions are arranged in rows extending parallel to the rows of the nozzles 11*a* or pressure chambers 23 (i.e., in the second or Y-axis direction), and the number of the rows of the active portions is the same as that of the nozzle rows, namely, five. The five rows of the active portions are arranged in the first or X-axis direction. Each active portion is formed in a shape long in the longitudinal direction of each pressure chamber 23, that is, in the first direction, which is parallel to the width direction of the cavity unit 10, and the X-axis direction. The active portions are arranged at constant spacing intervals, namely at a pitch P, which is the same as arrangement of the pressure chambers 23, as will be described later, and in a staggered configuration.

Figure 4:
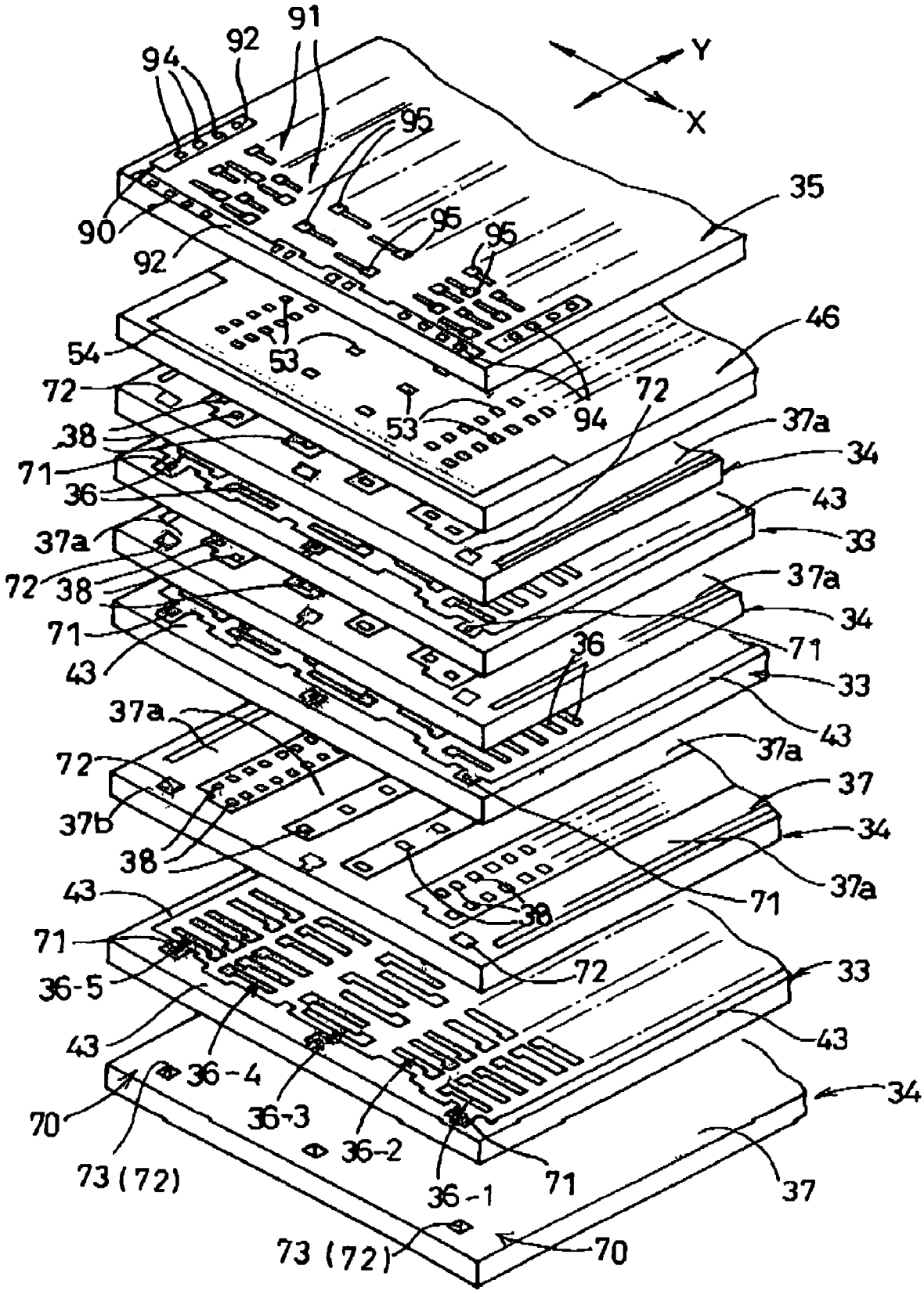
FIG. 4 is an exploded perspective view of a part of a piezoelectric actuator constituting the inkjet printhead.

As shown in FIG. 4, the piezoelectric actuator 12 is constituted by a laminate including a group (seven in the present embodiment) of piezoelectric sheets 33 and 34 which are stacked alternately, a constraining layer 46 constituted by a single sheet (which may be referred to as an "upper layer sheet" hereinafter) and superposed on an upper surface of the group of piezoelectric sheets 33, 34, and a top sheet 35 as a surface sheet superposed on an upper side of the upper layer sheet 46 as the constraining layer. Each of the sheets 33, 34 is made of a piezoelectric ceramic plate having a thickness of about 30 μm. The upper layer sheet 46 and the top sheet 35 may be formed of a piezoelectric ceramic plate, or any other insulative material.

Figure 5:
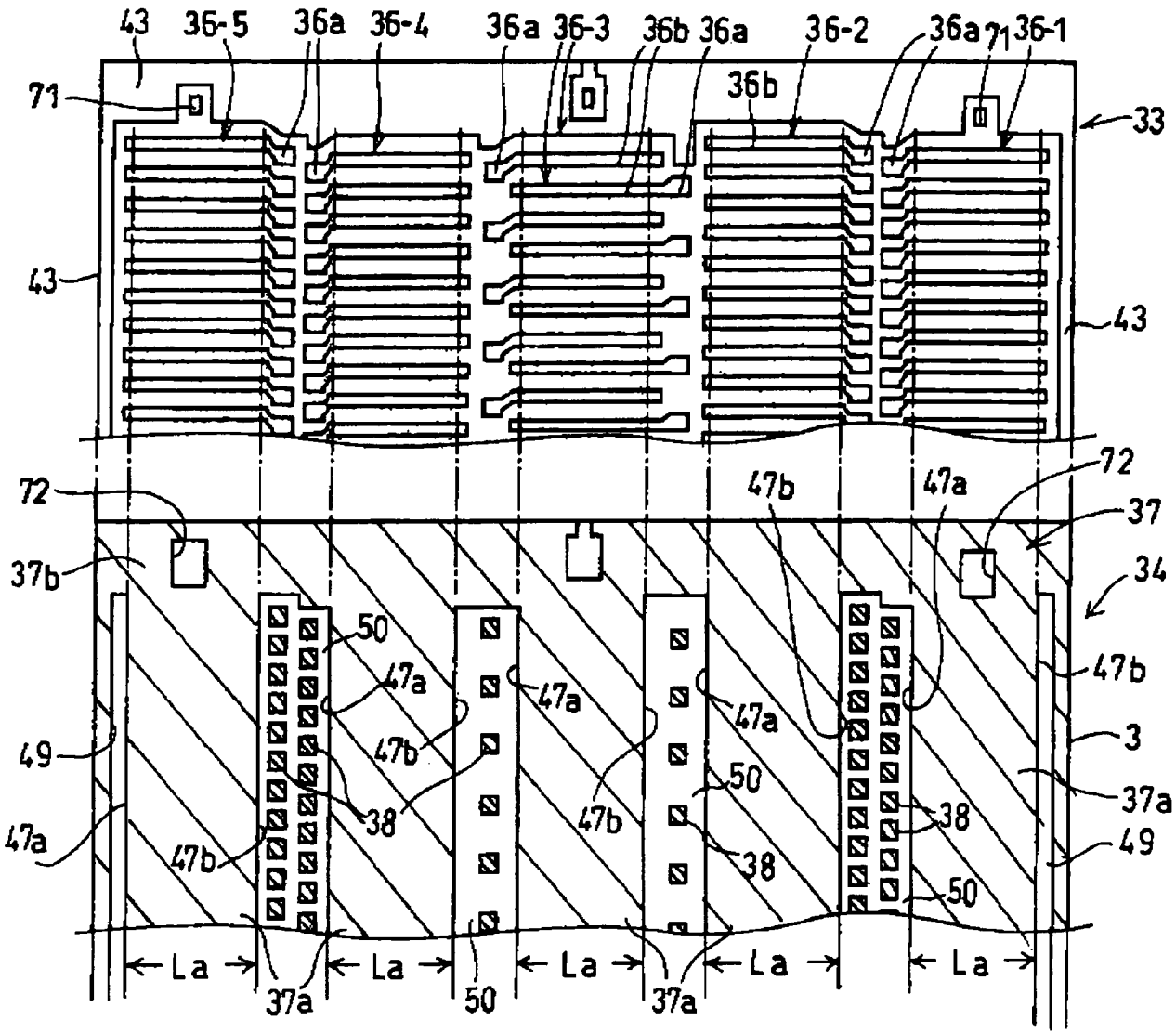
FIG. 5 is a fragmentary plan view showing side by side in a first direction, a piezoelectric sheet having individual electrodes and another piezoelectric sheet having a common electrode.
Figure 6:
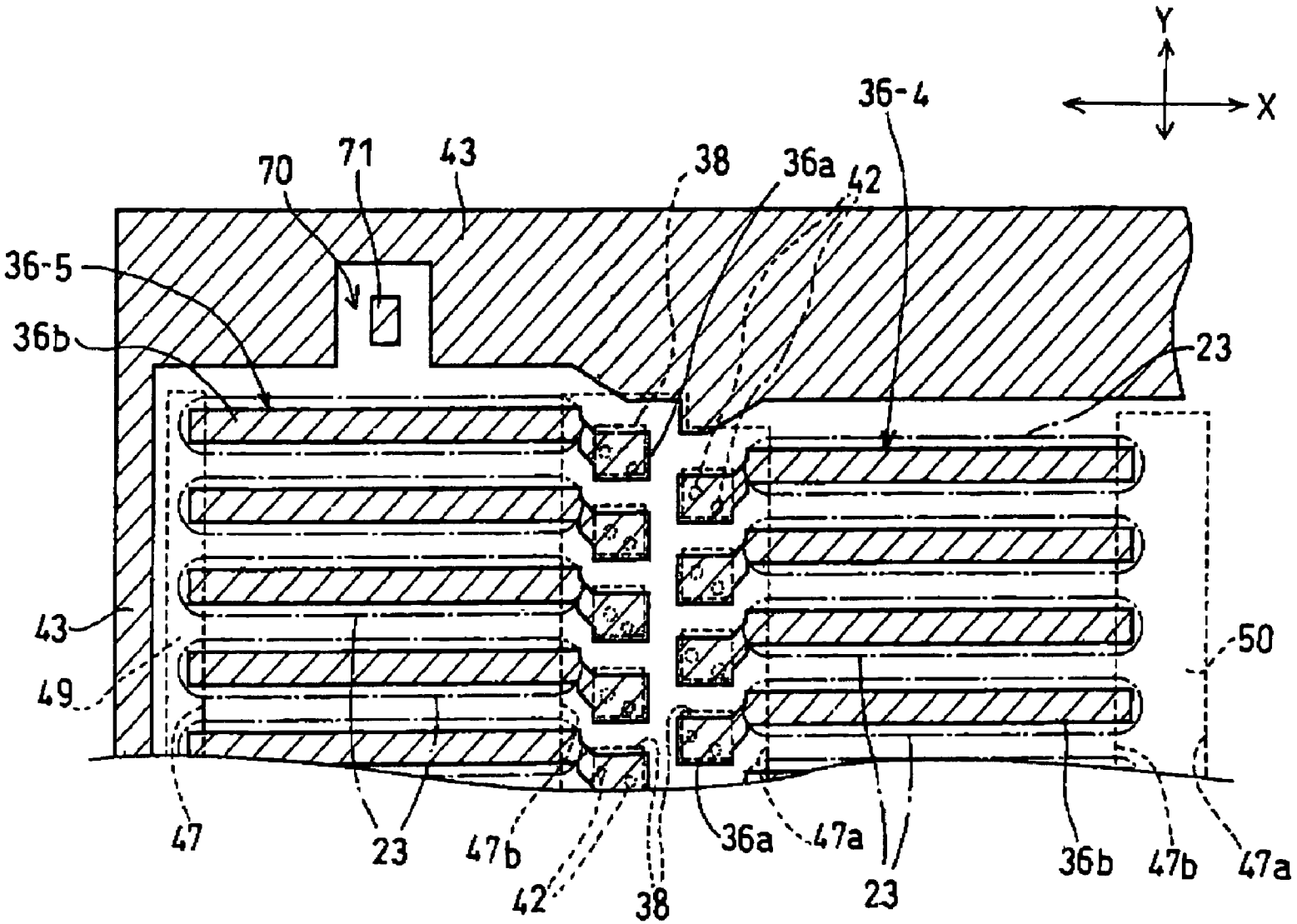
FIG. 6 is a fragmentary plan view showing the common electrode and the individual electrodes that are overlapping in a direction of stacking of sheets on which the individual and common electrodes are formed.

As shown in FIGS. 4-6, on a flat upper surface of each of the piezoelectric sheets 33, which are even-numbered ones of all the seven sheets 33, 34 as counted from the bottom, there are formed, by screen printing, elongate individual electrodes 36 at respective positions over the pressure chambers 23 formed in the cavity unit 10. More specifically, the individual electrodes 36 are arranged in five rows each extending along the second direction, which is the longitudinal direction of the piezoelectric sheets 33 which is parallel to the Y-axis direction as shown in FIG. 2, as well as the direction of each nozzle row. Thus, the rows of the individual electrodes 36 are arranged in the X-axis direction.

More specifically described, as shown in FIGS. 4 and 5, first through fifth rows of individual electrodes 36 (that are respectively denoted by reference numerals 36-1, 36-2, 36-3, 36-4, 36-5) are formed on an upper surface of each of the piezoelectric sheets 33 so as to positionally correspond to the above-described first through fifth rows of pressure chambers 23-1, 23-2, 23-3, 23-4, 23-5. Each of the individual electrodes 36 has a straight part 36*b* formed in a linear shape, which has a length substantially identical with that of each pressure chamber 23 as indicated by one-dot chain line in FIG. 6, and a width slightly smaller than that of each pressure chamber 23. That is, the straight part 36*b* of each individual electrode 36 is substantially rectangular shape longer in the X-axis direction than the Y-axis direction. Each straight part 36*b* overlaps a corresponding one of the pressure chambers 23 as seen from the upper side of the actuator 12.

One 36*a* of opposite longitudinal end parts of each individual electrode 36 is bent with respect to the straight part 36*b* to extend to the outside of the pressure chamber 23 as seen from the upper side of the actuator 12, as shown in FIGS. 5 and 6. This end part 36*a* of each individual electrode 36 constitutes a terminal. The end parts 36*a* of respective individual electrodes 36-3 of the third row are disposed on the outer side of the respectively corresponding pressure chambers 23, alternately on the opposite sides in the longitudinal direction of the individual electrodes 36-3.

On each of the piezoelectric sheets 33, there is formed a dummy common electrode 43 at a position to partially overlap with the common electrodes 37 on the piezoelectric sheets 34 as seen from the upper side. The position of the dummy common electrode 43 includes margins, namely, both the shorter and longer sides, of an upper major surface of each piezoelectric sheet 33, as shown in FIGS. 4-6. In FIG. 6, a dummy common electrode 43 is indicated by hatching.

The common electrodes 37 are formed by screen printing on an upper surface of each of odd-numbered piezoelectric sheets 34 as counted from the bottom, as shown in FIG. 4. The common electrode 37 formed on the lowermost piezoelectric sheet 34 is formed over an entire upper surface thereof. The common electrodes 37 formed on the other piezoelectric sheets 34 are formed to overlap with the rows 23-1, 23-2, 23-3, 23-4, 23-5 of the pressure chambers and accordingly with the rows 36-1, 36-2, 36-3, 36-4, 36-5 of the individual electrodes as seen from the upper side. Each common electrode 37 (except the one formed on the lowermost piezoelectric sheet 34) has five first electrically conductive parts 37*a* extending in the Y-axis direction or parallel to the longer sides of the piezoelectric sheet 34, and two second electrically conductive parts 37*b* extending in the X-axis direction and along the respective shorter sides of the piezoelectric sheet 34, as indicated by hatching in FIG. 5. Opposite ends of each of the first conductive parts 37*a* are connected to the two second conductive parts 37*b*, respectively. The number (namely, five) of the first conductive parts 37*a* each of which is ribbon-shaped corresponds to the number of the rows of the individual electrodes 36. As shown in FIG. 5, each first conductive part 37*a* has a pair of edges 47*a*, 47*b* extending to be within the range or length of the longer sides of the rectangular shape of the straight part 36*b* of each individual electrode 36. A distance between the pair of the edges 47*a*, 47*b*, that is, a dimension of the first conductive part 37*a* in the X-axis direction is La.

As shown in FIG. 5, in each of the outermost two of the first conductive parts 37*a* of the common electrode 37 as arranged in the X-axis direction, there is a narrow nonconductive portion 49, at which an upper surface of the piezoelectric sheet 34 is left exposed without an electrically conductive paste printed thereon. Each of the narrow nonconductive portions 49 has the shape of a narrow ribbon having a small width and rectangular in plan view. Each of the narrow nonconductive portions 49 is located near one of two edges of the piezoelectric sheet 34 extending in the Y-axis direction. At an area between two adjacent first conductive parts 37*a*, the piezoelectric sheet is left exposed without the conductive paste printed, thereby forming a wide nonconductive portion 50. Four wide nonconductive portions in total are formed on the piezoelectric sheet 34. Each of the wide nonconductive portions is also rectangular in plan view, but has a wider width than the narrow nonconductive portion 49. The wide nonconductive portions 50 are parallel to the narrow nonconductive portions 49. In each of the wide nonconductive portions 50, a plurality of discrete dummy individual electrodes 38 are arranged in a line or lines. The dummy individual electrodes are located at respective positions to overlap the end parts or terminals 36*a* of the individual electrodes 36 as seen from the upper side of the actuator 12. In this way, each of the edges 47*a*, 47*b* of the first conductive parts 37*a* is provided by one of the following: an inner one of two edges or borderlines of one of the narrow nonconductive portions 49, which edges extend in the Y-axis direction; and one of two edges or borderlines of one of the wide nonconductive portions 50, which edges extend in the Y-axis direction. The distance La between each pair of the edges 47*a*, 47*b* is determined in connection with this.

When stacked, the piezoelectric sheets 33 and 34 are relatively positioned such that the individual electrodes 36 and the respectively corresponding first conductive parts 37*a* of the common electrodes 37 overlap, and both longitudinal ends, in the first direction or the X-axis direction, of each of the individual electrodes 36 are located outside the edges 47*a*, 47*b* of the corresponding first conductive part 37*a*, in the X-axis direction, so that the distance La between each pair of the edges 47*a*, 47*b* determines a dimension of the active portion in the first direction, as shown in FIGS. 5 and 6.

As shown in FIG. 5, in a middle one 36-3 of the five rows of the individual electrodes 36, namely, the one located at the center of the piezoelectric sheet 33 in the direction of the shorter sides thereof, the end parts 36*a* or terminals of two individual electrodes 36 adjacent to each other in the second direction or the Y-axis direction protrude to the outside of the edges 47*a*, 47*b* of the corresponding one of the first conductive parts 37*a* alternately on the opposite sides. Each end part 36*a* overlaps, in plan view or in the stacking direction, at least a part of the corresponding one of the discrete dummy common electrodes 38, which are arranged at constant intervals in one of the wide nonconductive portions 50.

As shown in FIG. 4, on the upper layer sheet 46 as a constraining layer, the linking electrodes 53, each of which is generally rectangular as seen from the upper side, are disposed at constant spacing intervals so that each linking electrode 53 overlaps at least a part of a corresponding one of the dummy individual electrodes 38 formed on the piezoelectric sheet 34, as seen from the upper side. At a portion of an upper surface of the upper layer sheet 46, including marginal portions along the shorter sides of the upper surface, there are formed in a patterned fashion communication electrodes 54 as conductive portions for common electrodes to overlap with a part of the common electrodes 37 on each piezoelectric sheet 34 and a part of the dummy common electrodes 43 on each piezoelectric sheet 33, as seen from the upper side.

Through each of the upper layer sheet 46 and the piezoelectric sheets 33, 34, except the lowermost piezoelectric sheet 34, internal conduction electrodes (not shown) are formed by filling each of a plurality of through-holes formed through the thickness of the sheet 46, 33, 34, at positions corresponding to the common electrode 37 and dummy common electrode 43, with an electrically conductive material or paste, so that the common electrodes 37 and the dummy common electrodes 43 are electrically connected in a vertical direction at a plurality of places.

Figure 7A:
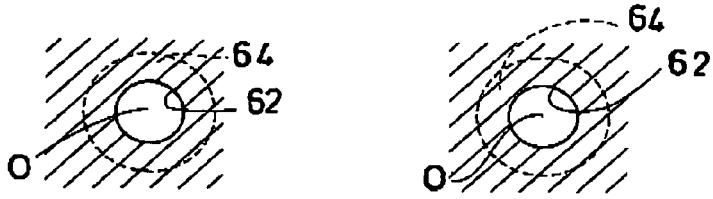
FIG. 7(*a*) schematically shows how first detection portions formed in the cavity unit looks like when viewed with an image receiver, and FIG. 7(*b*) shows how a light source, the image receiver, and the cavity plate are arranged when the detection portions is detected.
Figure 7B:
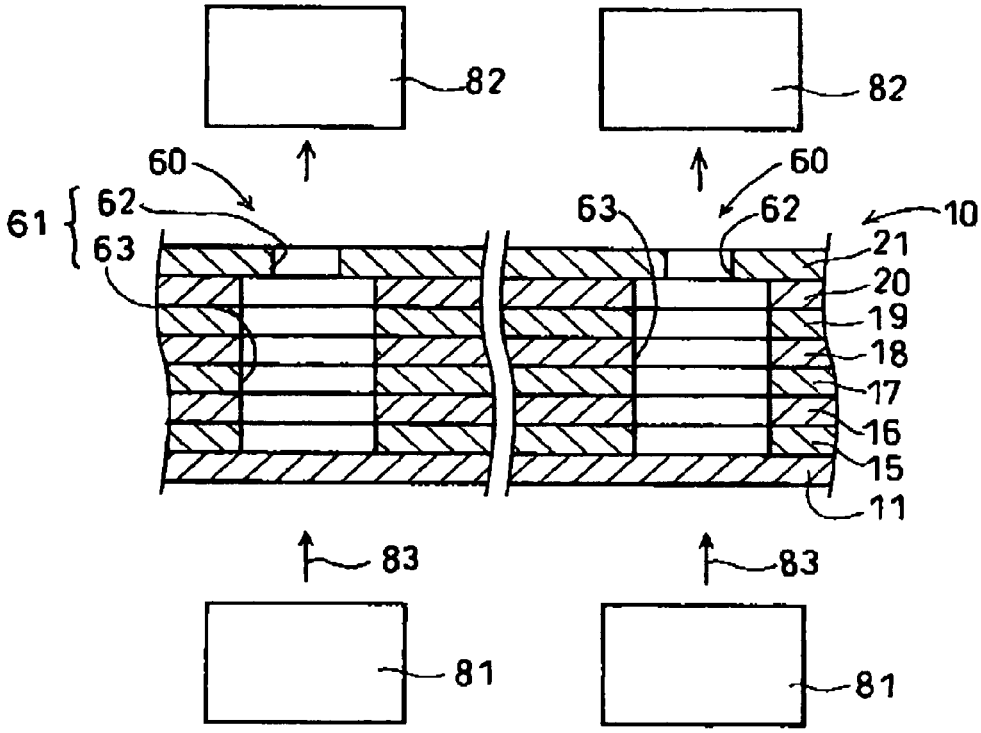
Figure 8A:
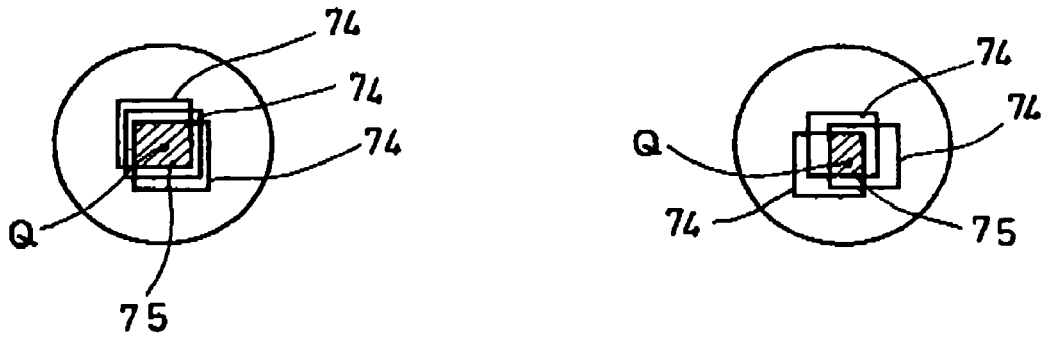
FIG. 8(*a*) schematically shows how second detection portions formed in the piezoelectric actuator looks like when viewed with an image receiver, and FIG. 8(*b*) shows how a light source, the image receiver, and the piezoelectric actuator are arranged when the detection portions is detected.
Figure 8B:
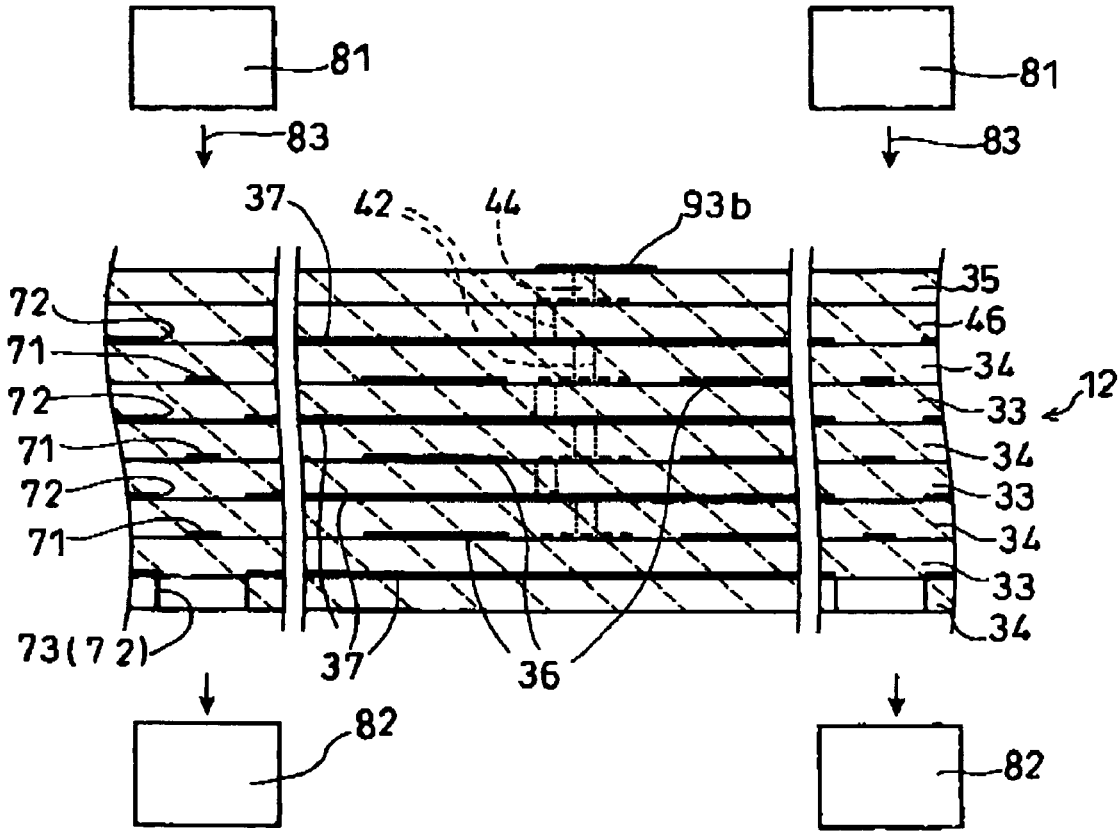

Similarly, to electrically connect, in the vertical direction, the end parts 36*a* of the individual electrodes 36 on the piezoelectric sheets 33, the dummy individual electrodes 38 on the piezoelectric sheets 34, and the linking electrodes 53 on the upper layer sheet 46, a plurality of internal conduction electrodes 42 are formed through each of the piezoelectric sheets 33, 34, and the upper layer sheet 46, by filing a plurality of through-holes formed through each sheet 33, 34, 46 with an electrically conductive material or paste, as shown in FIG. 8. The internal conduction electrodes 42 are formed at positions such that each internal conduction electrode 42 is spaced with a suitable distance from other internal conduction electrode(s) 42 that is/are formed through the sheet(s) 33, 34 immediately over/under the piezoelectric sheet, as seen from a side of the actuator 12, as shown in FIGS. 6 and 7.

As shown in FIG. 4, on an upper surface of the top sheet 35 as a surface sheet or the uppermost layer of the piezoelectric actuator 12, connecting terminals (connecting electrodes) 90 for connection with the common electrodes as well as connecting terminals (connecting electrodes) 91 for connection with the individual electrodes are formed separately from one another in a configuration like islets. The two kinds of connecting terminals 90, 91 are to be connected to bump electrodes (not shown) for connection with the common electrodes and bump electrodes (not shown) for connection with the individual electrodes, respectively, that are formed on an under surface of the flexible flat cable 40.

Each of the connecting terminals 90 has a thin surface electrode 92 formed on the upper surface of the top sheet 35 and a thick external electrode 94 formed on the surface electrode 92. Similarly, each of the connecting terminals 91 has a thin surface electrode 93 formed on the upper surface of the top sheet 35 and a thick external electrode 95 formed on the surface electrode 93. To electrically connect, in the vertical direction, the connecting terminals 90 and the connecting terminals 91 on the top sheet 35 to the communication and linking electrodes 54, 53 on the upper layer sheet 46, internal conduction electrodes 44 are formed by filling a plurality of through-holes formed through the thickness of the top sheet 35 with an electrically conductive material or paste, in the same way as described above with respect to the internal conduction electrodes for the connection among the common electrodes 37 and the dummy common electrodes 43 and among the end parts 36*a*, dummy individual electrodes 38, and the linking electrodes 53, as shown in FIG. 8.

The thin surface electrode 92 of the connecting terminal 90 for connection with the common electrodes are disposed at respective positions to overlap at least a part of a corresponding one of the communication electrodes 54 on the upper layer sheet 46, as seen from the upper side. Each surface electrode 92 is formed in a strip-like shape or other shapes at a place near an edge of the upper surface of the top sheet 35, as shown in FIG. 4. The thick external electrodes 94 are formed in a suitable shape on the thus formed surface electrode 92.

The surface electrodes 92, individual electrodes 36, common electrodes 37, dummy individual electrodes 38, dummy common electrodes 43, internal conduction electrodes 42, 44 filling the through-holes, linking electrodes 53, and communication electrodes 54 are formed by screen-printing using an electrically conductive Ag—Pd (silver-palladium)-based material or paste, on green sheets to be formed into the piezoelectric sheets 33, 34, upper layer sheet 46, and the top sheet 35, and then stacking theses sheets 33, 34, 35, 46 in a predetermined order and firing the stack at a first temperature. Since the melting point of the Ag—Pd-based material is high, evaporation thereof does not occur even when the first temperature at which the green sheets are fired is high. However, the Ag—Pd-based material is not excellent in bonding characteristics with respect to a solder alloy.

The external electrodes 94, 95 are formed by screen-printing an electrically conductive material or paste containing silver and a glass frit suitable for forming electrodes of a relatively large thickness, on the surface electrodes 92 as have been fired as described above, and then firing the structure of the stacked sheets at a second temperature lower than the first temperature. The electrically conductive material or the paste containing the silver and the glass frit is low in the melting point, but is excellent in bonding characteristics with respect to a solder alloy, compared to an Ag—Pd-based material. Therefore, according to the arrangement where the connecting terminals 90, 91 are such that the external electrodes 94, 95 are formed on the surface electrodes 92, 93, respectively, bonding characteristics of the connecting terminals 90, 91 with respect to the bump electrodes on the flexible flat cable 40 improves, compared to an arrangement where such external electrodes 94, 95 are not provided.

There will be now described how the cavity unit 10 and the piezoelectric actuator 12 are aligned or positioned relatively to each other when assembled.

The cavity unit 10 has four first detection portions 60, as shown in FIG. 1, for use in positioning relatively to the piezoelectric actuator 12. The first detection portions 60 correspond to upper end portions 62 of respective bores 61 that extend through the cavity unit 10 in the stacking direction thereof as shown in FIG. 7(*b*).

The first detection portions 60 are respectively disposed at four corners of the cavity unit 10 that is substantially rectangular in plan view, as shown in FIG. 1. The upper end portion of each of the bores 61 is formed as an opening through the cavity plate 21, to constitute a first portion 62 of the bore 61. A second portion 63 of the through-hole is formed through the other six plates of the cavity unit 10, namely, the base plate 20, supply plate 19, manifold plates 18, 17, damper plate 16, and spacer plate 15, such that the second portion 63 is disposed under the first portion 62 in alignment with the first portion 62, as shown in FIG. 2. The four first portions and four second portions that are to cooperate to constitute the four bores 61 are formed at respective positions that do not interfere with individual ink passages formed in the cavity unit 10 correspondingly to the respective nozzles and. Both the first and second portions 62, 63 are circular in plan view, but a diameter of the second portion 63 is larger than that of the first portion 62, as shown in FIGS. 7(*a*) and 7(*b*).

The second portion 63 of each bore 61 is covered by the nozzle plate 11 having a light transmission, on the front side, or on the side of the nozzle surface. If the bores 61 are formed through the nozzle plate 11 also, ink adhering to the front side of the nozzle plate 11, or a mist of ink particles produced upon ejection of ink droplets from the nozzles 11*a*, might enter the piezoelectric actuator 12 through the bores 61 formed in the nozzle plate 11, after the user starts using the inkjet printhead 1. This may cause short-circuit or other failures in the electrical connection at the electrode(s) in the piezoelectric actuator 12. In the present embodiment, however, in view of formation of the nozzles, the nozzle plate 11 is made of polyimide resin having a light transmission. The covering the front side of the second portion 63 of each bore 61 by the nozzle plate 11 prevents introduction of the ink into the bores 61 while enabling irradiation of the first detection portions 60 with light from the front side of the inkjet printhead 1, in detecting the first detection portions 60 for the positioning between the cavity unit 10 and the piezoelectric actuator 12.

The first and second portions 62, 63 of the bores 61 are formed concurrently with the formation of through-holes or others that are to constitute the individual ink passages in respective plates of the cavity unit 10. That is, an additional step for forming the first and second portions 62, 63 is not necessary. The first portions 62 are formed through the cavity plate 21 by etching, concurrently with formation of through-holes that are to constitute the pressure chambers 23, in a predetermined positional relationship with the pressure chambers 23.

According to this arrangement, since the opening or the first portion 62 of each bore 61 is formed through the cavity plate 21, the accuracy and the precision of the position of the first portion 62 relatively to the corresponding pressure chamber 23 is relatively high, thereby ensuring a high accuracy and precision in alignment of the pressure producing portions with the pressure chambers when superposing the piezoelectric actuator 12 on the cavity unit 10, as will be described in detail later.

On the other hand, the piezoelectric actuator 12 also has four detection portions 70 (constituting second detection portions) for use in positioning relatively to the cavity unit 10. The second detection portions 70 are respectively disposed at four corners of the piezoelectric actuator 12 having a substantially rectangular shape in plan view, as shown in FIGS. 1 and 4.

Each second detection portion 70 has three marking portions 71 and four blank portions 72. The marking portions 71 are formed in the respective piezoelectric sheets 33 at a position near a shorter side thereof, and each marking portion 71 is rectangular. The blank portions 72 are formed in the respective piezoelectric sheets 34 at a position corresponding to the marking portions 71.

The marking portions 71 are formed of the same electrically conductive material or paste as the electrodes, and arranged discretely or separately. Each of the marking portions 71 is not continuous with any of the individual electrodes 36 and the dummy common electrodes 43 on the piezoelectric sheets 33.

The blank portion 72 on the lower most piezoelectric sheet 34 is formed as a through-hole 73. The blank portions 72 on the respective piezoelectric sheets 34 except the lowermost one 34 are formed in the second conductive parts 37*b* of the common electrodes 37, as an area where the piezoelectric sheet is left exposed without the conductive material or past printed thereon. The blank portion 72 is formed to have a larger area than the marking portion 71. In the upper layer sheet 46 and the top sheet 35, the conductive material or paste is not disposed at the position overlapping the marking portions 71 in the stacking direction. Since the piezoelectric sheets have a light transmission after fired, shades 74 cast by the respective marking portions 71 are detectable by irradiating with light the second detection portions 70 from a side of the stack of the piezoelectric sheets and receiving the light on the opposite side of the stack, as shown in FIGS. 8(*a*) and 8(*b*).

The marking portions 71 are formed on the piezoelectric sheet 33 concurrently with the formation of the individual electrodes 36 on the same piezoelectric sheet 33, in a predetermined positional relationship with the individual electrodes 36. The blank portions 72 are formed on the piezoelectric sheet 34 concurrently with the formation of the common electrode 37 on the same piezoelectric sheet 34, in a predetermined positional relationship with the common electrode 37.

There will be now described how the thus constructed cavity unit 10 and piezoelectric actuator 12 are assembled. U.S. Pat. No. 6,773,095 B2 is incorporated herein by reference in its entirety.

First, the first detection portions 60 in the cavity unit 10, and the second detection portions 70 in the piezoelectric actuator 12 are separately detected.

Figure 9:
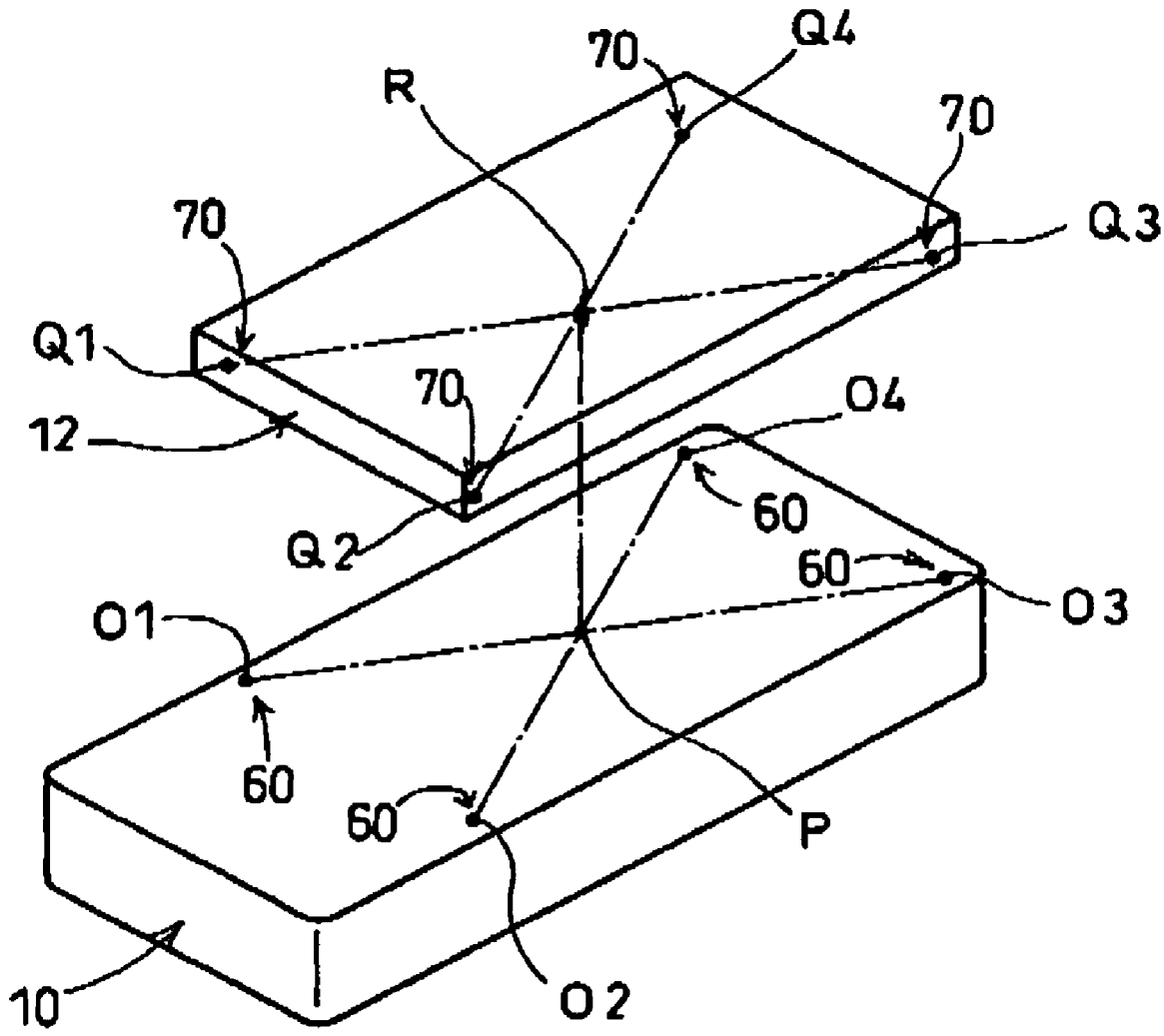
FIG. 9 is a perspective view illustrating how the cavity unit and the piezoelectric actuator are positioned relatively to each other.

The detection of the first detection portions 60 in the cavity unit 10 will be described. When the first detection portions 60 are detected, the cavity unit 10 is in the form of one of a plurality of cavity units 10 not yet separated into a plurality of individual cavity units 10 from lead frames assembled, which is held by a jig (not shown), as disclosed in U.S. Pat. No. 6,536,879 B2 (especially FIG. 9), the content of which is incorporated herein by reference. There is used for the detection an apparatus as shown in FIG. 7(*b*), which includes a light source 81, an image receiver 82, and an image processor (not shown) connected to the image receiver 82. The light source is set at the side of the cavity unit 10 on the side near the nozzle plate 11, i.e., the lower side of the cavity unit 10 in FIG. 7(*b*), so as to emit a beam of light toward the bores 61. The light beam 83 passes through the nozzle plate 11 and then travels along the bores 61, to be eventually received by the image receiver 82 located at the side of the cavity unit 10 near the cavity plate 21, i.e., the upper side of the cavity unit 10 in FIG. 7(*b*). In a field of view of the image processor (not shown), the light beam 83 as has passed through each bore 61 shows up as an illumination defined inside a contour of the bore 61 or the first portion 62 thereof, while the back surface of the cavity unit around an open end of the first portion 62 of the bore 61 appears as a dark shadow 64 as indicated by hatching in FIG. 7(*a*), enabling to recognize the contour of the first portion 62 of the bore 61 in a fashion as shown in FIG. 7(*a*). The center O of the circular shape of the first portion 62 of the bore 61 is determined by the image processor, as shown in FIG. 9. Individually, the centers O of the respective first portions 62 of the four bores 61 are denoted by reference symbols O1, O2, O3, and O4. Two diagonal lines are drawn between two centers O1-O4 at opposing corners, that is, a diagonal line is drawn between the centers O1 and O3, and another diagonal line is drawn between the centers O2 and O4, as shown in FIG. 9. An intersecting point P of the two diagonal lines is determined as a reference point of the cavity unit 10.

According to the above-described arrangement, the image that the image receiver captures has a high contrast at the contour of the first portion 62 of the bore 61, that is, between the light passing through the first portion 62 and a member around and defining the bore 61, without the flaws such as streaks made during rolling of the metallic sheet constituting the top sheet 35 of the cavity plate 21 being recognized by the image receiver. Therefore, the contour of the first portion 62 of the bore 61 can be accurately and precisely detectable. Actually, the configuration of the bore 61 constituting a detection portion allows detection of the detection portion by irradiating the detection portion with light from the upper side and receiving the light as reflected, as seen in the conventional technique, since a through-hole, not a mere dent, can provide a sufficiently high contrast in the captured image. However, since the upper surface or the back surface of the cavity unit 10 may have flaws that deteriorate the accuracy and the precision in the detection the position of the first portion 62 of the bore 61. Thus, in the embodiment, light is emitted from the lower or front side of the cavity unit 10 and an image is captured on the upper or back side of the cavity unit 10. In other words, even in the case where flaws or the like are present on the upper surface of the cavity unit 10, the detection of the position of the first portion 62 of the bore 61 is not adversely affected thereby, but is detectable with high accuracy and precision. On ground of this, the invention excludes an arrangement where the cavity unit is irradiated from the upper or back side thereof to obtain an image based on the reflected light.

The arrangement that the diameter of the second portion 63 is larger than that of the first portion 62 enables to detect the contour of the first portion 62 without the light blocked by any of the plates defining the second portion 63. Thus, according to the present embodiment, a bore through which light radiated from the side of the cavity unit opposite to the pressure chambers can travel without being blocked is easily formed.

The adhesive may flow into the second portion 63 when stacking the plates to laminate the cavity unit 10. However, the dimensions of the second portion 63 are sufficiently large to keep the contour of the first portion 62 detectable.

There will be described detection of the second detection portions 70 in the piezoelectric actuator 12. The detection of the second detection portions 70 is performed while the piezoelectric actuator 12 is held by another jig (not shown) and at a place different from a place where the detection of the first detection portions 60 is performed. There is used an apparatus not identical with that as used for detecting the first detection portions 60, but similarly including a light source 181, an image receiver 182, and an image processor (not shown) connected to the image receiver 182. The light source 181 is set at the side of the piezoelectric actuator 12 on the side of the top sheet 35, i.e., the upper side of the piezoelectric actuator 12 as seen in FIG. 8(*b*), so as to irradiate the piezoelectric actuator 12 with a beam of light therefrom in the stacking direction of the piezoelectric sheets. The piezoelectric sheets as has been fired has a light transmittance, and any interfering electrode or others is not present in the way of the light beam 183, except the marking portions 71, the three marking portions 71 formed on the respective three piezoelectric sheets 33 are projected in an overlapping manner on the image receiver 182 located at the side of the piezoelectric actuator 12 on the side of the lowermost one of the piezoelectric sheets 34, i.e., on the lower side of the piezoelectric actuator 12. In a field of view of the image processor (not shown), shades 74 of the three overlapping marking portions 71 are recognized, as shown in FIG. 8(*a*). Since the piezoelectric actuator 12 suffers from a positioning error in stacking the piezoelectric sheets, and a variation in contraction during the firing, contours of the three shades 74 do not necessarily overlap one another completely. Hence, the image processor determines a center of gravity Q of each second detection portion 70 based on a darkest area 75 where all of the three shades 74 overlap, as indicated by hatching in FIG. 8(*a*). As shown in FIG. 9, two diagonal lines are drawn between two opposite centers Q1-Q4 of gravity, namely, a diagonal line is drawn between the centers Q1 and Q3, and another diagonal line is drawn between the centers Q2 and Q4. An intersecting point R of the two diagonal lines is determined as a reference point of the piezoelectric actuator 12.

Each center of gravity Q is obtained as a center of gravity of the darkest area 75. It is noted, however, that the point that should be obtained for each of the second detection portion in determination of the reference point R is in nature a mean value of three coordinate points representative of the center points, or the centers of gravity, of the three shades 74, respectively, that is, a mean value of the X-coordinate and that of the Y-coordinate for the coordinate points of the centers of gravity of the three shades 74. From the darkest area 75, the mean values of the X-coordinate and the Y-coordinate can not be obtained, but the center of gravity of the darkest area 75 can. However, when the positional error among the three shades 74 is small, the X- and Y-coordinates of the center of gravity of the darkest area 75 do not greatly differ from the mean values of the X- and Y-coordinates of the centers of gravity of the three shades 74. Hence, the former can be used in place of the latter.

Next, at a place other than the places where the detection portions 60, 70 of the cavity unit 10 and the piezoelectric actuator 12 are respectively detected, the jig holding the piezoelectric actuator 12 is positioned relatively to the lead frame assembly, so as to superpose the piezoelectric actuator 12 on one of the cavity units 10 in the lead frame assembly, such that the reference point P of a cavity unit 10 and the reference point R of the piezoelectric actuator 12 align. It is preferable that in the state where the piezoelectric actuator 12 is held by the jig, and before the piezoelectric actuator 12 is put on the lead frame assembly, positional errors of the piezoelectric actuator, including lateral position errors in two perpendicular directions and an angular error, due to deformation of the piezoelectric actuator 12 caused during firing thereof or other reasons, are obtained by computation, to enable to thereafter eliminate such positional errors upon assembly of the lead frame assembly and the piezoelectric actuator 12. In a case where all of the positional errors are corrected in superposing the piezoelectric actuator 12 on the cavity unit 10, not only the aligning the reference points P, R, but also the elimination of the angular error are performed. Then the cavity unit 10 and the piezoelectric actuator 12 are bonded to each other.

By thus positioning the cavity unit 10 and the piezoelectric actuator 12 relatively to each other with high accuracy and precision based on the positions of the first detection portions 60 obtained from the light radiated through the cavity unit 10, and the positions of the second detection portions 70 obtained from the light radiated through the piezoelectric actuator 12, the individual electrodes in the piezoelectric actuator 12 are accurately and precisely aligned with the respectively corresponding pressure chambers 23 in the cavity unit 10, as shown in FIG. 6, thereby enabling to produce an inkjet printhead 1 exhibiting an excellent ink ejection performance.

When positioning the piezoelectric actuator 12 relatively to the cavity unit 10, it is desirable that the piezoelectric actuator 12 is positioned such that positional errors between the large number of pressure producing portions and the respectively corresponding pressure chambers are minimum as a whole. For instance, the piezoelectric actuator 12 is positioned such that the positional error between a pressure producing chamber and a corresponding pressure chamber between which the positional error will be the largest among all the pairs, becomes minimum. Hence, it is desirable that a closed area in the cavity unit across which area the large number of pressure chambers are arranged, and a closed area in the piezoelectric actuator 12 across which area the large number of pressure producing portions are arranged, are congruent or similar in figure, and centers of gravity of the closed areas are aligned. Thus, it is desired that the detection portions of the cavity unit 10 and those of the piezoelectric actuator 12 are disposed at such positions that enables to easily obtain the centers of gravity of the closed areas, as in the above-described embodiment.

However, this is not necessarily essential. That is, as long as a point is disposed within a central portion of the closed area in the cavity unit 10 and at a relative position with respect to the pressure chambers, and a point is disposed within a central portion of the closed area in the piezoelectric actuator 12 and at a relative position with respect to the pressure producing portions, such that when the points are aligned, the positional errors between the pressure chambers and the respectively corresponding pressure producing portions are minimized as a whole, such points may be employed as reference points of the cavity unit and the piezoelectric actuator 12, in place of the above-described centers of gravity of the closed areas. For example, this way of determining the reference points are effective when the detecting portions in at least one of the cavity unit 10 and the piezoelectric actuator 12 can not be disposed at such positions that enable to locate the reference point at the ideal position as described above, because of restriction by the surroundings or for other reasons. That is, when the detection portions can not be located at positions to allow easily obtaining the center of gravity of the closed area in the cavity unit or the piezoelectric actuator, those detection portions may be located at respective positions that set the reference point within the central portion of the closed area in the cavity unit or the piezoelectric actuator and at a relative position with respect to the pressure chambers or the pressure producing portions.

As a method of determining the position of the reference point relatively to the detecting portions, the above-described one in which an intersecting point of two diagonal lines each drawn between two centers of gravity of respective detection portions is advantageous in its easiness, and an appropriateness of the reference point obtained by the method. However, the method of determining the position of the reference point is not limited to this.

In the above-described embodiment, four detection portions are provided in each of the cavity unit 10 and the piezoelectric actuator 12, but the number of the detection portions in the cavity unit 10 and that in the piezoelectric actuator 12 may not be four.

In the above-described embodiment, the actuator is of piezoelectric type. However, any other kind of actuator may be employed as long as the actuator can selectively drive the pressure chambers in the cavity unit 10.

What is claimed is:

1. An inkjet printhead comprising:

a cavity unit including:

a plurality of nozzles each for ejecting a droplet of ink;

a plurality of pressure chambers formed on a surface of the cavity unit on a first side thereof to respectively correspond to the nozzles; and a first detection portion formed in a given positional relationship with the pressure chambers;

an actuator disposed on the cavity unit, and including a plurality of pressure producing portions that correspond to the respective pressure chambers so as to selectively apply a pressure to the ink in each of the pressure chambers; and the first detection portion allowing light as radiated from a second side of the cavity unit that is opposite to the first side, to pass through the first detection portion to the first side, the first detection portion being used for positioning of the cavity unit relatively to the actuator so that the pressure chambers and the respectively corresponding pressure producing portions are positioned relatively to each other.

2. The inkjet printhead according to claim 1, wherein the first detection portion is an opening that is seeable from the first side of the cavity unit when the light is radiated from the second side of the cavity unit.

3. The inkjet printhead according to claim 2, wherein the opening constitutes one of opposite end portions of a bore that is formed in the cavity unit so that the light passes through the cavity unit along the bore, the other portion of the bore on the second side of the opening has an inner measurement larger than that of the opening.

4. The inkjet printhead according to claim 3, wherein the other end portion of the first detection portion is constituted by a light transmitting member that allows light to pass therethrough, at a position substantially the same as a surface of the cavity unit in which the nozzles open.

5. The inkjet printhead according to claim 2, wherein the cavity unit is constituted by a laminate a plurality of plates including a cavity plate in which the pressure chambers are formed, the opening is formed in the cavity plate, and each of the other plate or plates as stacked on the cavity plate has a through-hole that is formed at a position corresponding to the opening to have an inner measurement larger than that of the opening.

6. The inkjet printhead according to claim 5, wherein the other plates includes a nozzle plate in which the nozzles are formed, and at least one intermediate plate having a plurality of ink passages formed therein and sandwiched between the cavity plate and the nozzle plate, the ink passages connecting the pressure chambers with respectively corresponding nozzles, each of the at least one intermediate plate having the through-hole, and the nozzle plate being made of a resin material transmissive to light and covering an open end of the through-hole of a nearest one of the at least one intermediate plate to the nozzle plate, which open end is remote from the opening.

7. The inkjet printhead according to claim 1, wherein the actuator is constituted by a laminate of a plurality of piezoelectric sheets, and each of the pressure producing portions serves as an active portion that deforms upon application of a voltage to the piezoelectric sheets thereat, the actuator further having a second detection portion formed in a given positional relationship with the pressure producing portions so as to be detectable by irradiation of the actuator with light in a direction of stacking of the piezoelectric sheets, in order to position the actuator relatively to the cavity unit.

* * * * *